United States Patent [19]

Clark

[11] 4,103,717

[45] Aug. 1, 1978

[54] SEAM WEBBING

[75] Inventor: Gilbert A. Clark, Perth Amboy, N.J.

[73] Assignee: William Kenyon & Sons, Inc., Perth Amboy, N.J.

[21] Appl. No.: 697,338

[22] Filed: Jun. 18, 1976

[51] Int. Cl.[2] ..... D03D 25/00; D21F 1/12; D21F 7/10

[52] U.S. Cl. ..... 139/383 A; 28/141; 162/DIG. 1; 245/10

[58] Field of Search ..... 139/383 A, 383 R, 385, 139/118; 28/72 R, 141; 245/10; 162/DIG. 1; 24/33 C

[56] References Cited

U.S. PATENT DOCUMENTS

| | | | |
|---|---|---|---|
| 835,834 | 11/1906 | Schlegel | 139/385 |
| 2,582,342 | 1/1952 | Levers et al. | 139/385 |
| 2,883,734 | 4/1959 | Draper, Jr. | 139/383 A |
| 2,907,093 | 10/1959 | Draper, Jr. | 139/383 A |
| 3,225,900 | 12/1965 | MacBean et al. | 139/383 A |
| 3,283,388 | 11/1966 | Kelleher et al. | 28/72 R |
| 4,006,760 | 2/1977 | Romanski et al. | 139/383 A |

FOREIGN PATENT DOCUMENTS

| | | | |
|---|---|---|---|
| 982,682 | 2/1965 | United Kingdom | 139/383 A |
| 1,266,891 | 3/1972 | United Kingdom | 139/383 A |
| 1,072,317 | 6/1967 | United Kingdom | 139/383 A |

*Primary Examiner*—James Kee Chi
*Attorney, Agent, or Firm*—Bailey, Dority & Flint

[57] ABSTRACT

A woven seam webbing is illustrated for receiving pintle means for joining dryer felts or any other endless belts of the type which are joined by passing a pintle means through loops which are carried by respective ends of the belting and intermeshed. The loops comprise monofilament filling yarns which are carried adjacent an edge of the webbing being spaced so as to be intermeshed with loops carried by a similar webbing positioned at an opposite end of a dryer felt and the like.

5 Claims, 5 Drawing Figures

SEAM WEBBING

BACKGROUND OF THE INVENTION

According to the prior art generally in use in the mills, a hinge seam is provided which utilizes metallic clips hooked to narrow fabric webbing which is, in turn, sewed on the respective ends of the dryer felt. Such a typical construction is illustrated in U.S. Pat. No. 3,335,844. Other means of attaching the ends of felts or belting to form a continuous closed loop are illustrated in U.S. Pat. Nos. 3,324,516 and 3,283,388 which illustrate a seam member and method for making same respectively. These latter patents contemplate forming the seam member of woven material which is folded upon itself and severing the filling intermediate the woven fabric.

The webbing of the present invention possesses an important advantage in that it may be woven from a single thickness of webbing with the filling yarns forming loops which, are resilient and relatively stiff and which maintain good alignment and opening for reception of the pintle means. The loops are carried at substantially right angles to the webbing at the edge thereof and provide good strength and wear characteristics.

Accordingly, an important object of the invention is to provide a webbing having loops formed integrally therewith which have good strength and characteristics and which maintain their alignment and position for ready reception of the pintle means.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

Figure 1:
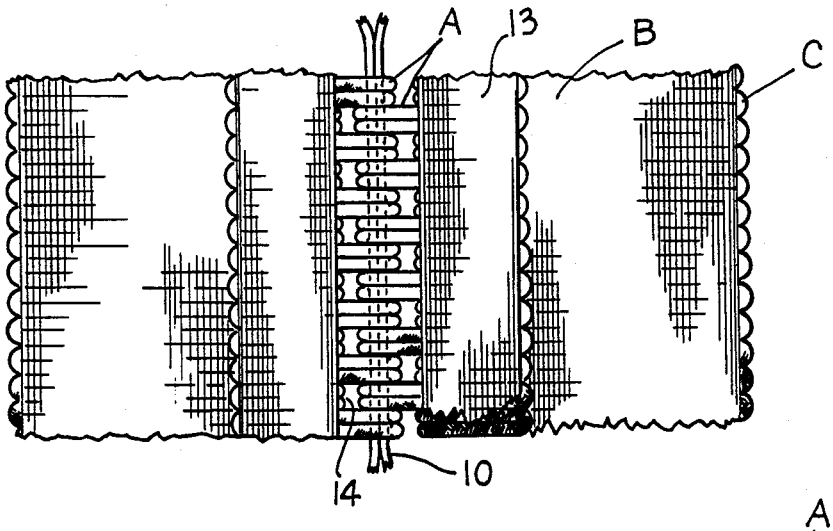
FIG. 1 is a plan view illustrating a woven seam webbing constructed in accordance with the present invention as for joining the ends of a dryer felt.

The drawing illustrates a woven seam webbing for use in receiving pintle means for joining dryer felts and the like. A series of spaced monofilament upright pintle receiving loops A are carried adjacent an edge of the web strip B. The monofilament loops are formed in spaced filling yarns C.

Figure 2A:
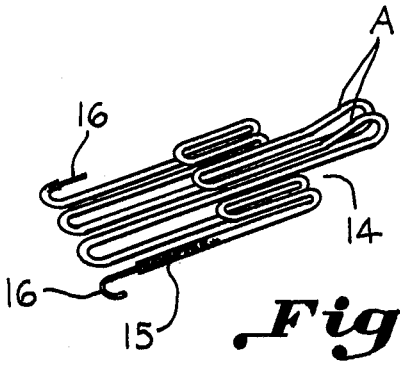
FIG. 2A is a schematic view illustrative of the filling configuration of a webbing such as illustrated in FIG. 1.
Figure 2:
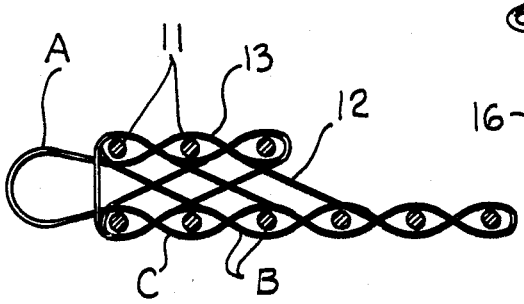
FIG. 2 is a schematic longitudinal sectional elevation illustrating the woven construction of webbing such as illustrated in FIG. 1.

Referring now particularly to FIGS. 1, 2 and 2A, suitable pintle means are illustrated in the form of pintle material 10 which extends through the intermeshed loops for locking together edges of a dryer felt and the like. The felt may be of any type and the webbing attached as by sewing in any customary fashion at respective ends of the felts (not shown). The warp yarns of the webbing strip B are illustrated at 11 while the loops A are formed in the filling yarns C. The loops A may be formed in any desired fashion, one well known way being to pass filling over a bar as illustrated in aforementioned U.S. Pat. No. 3,324,516 on one selvage, the usual webbing selvage being formed on the other side of the webbing as illustrated herein. All the filling yarn is illustrated herein as being of the same type although this is not thought to be necessary. The filling yarns are monofilament, preferably of synthetic polymer material as best illustrated in FIG. 2A, but metallic monofilament may be used. Binder yarns are provided for joining the upper and lower woven portions of the webbing together, an upper portion being illustrated at 13. The upper woven portions is terminated so that it only extends across a portion of the webbing strip as illustrated. The webbing strip is preferably an integral woven member providing a selvage at each edge so as to increase strength and wear characteristics.

In FIG. 2A the filling yarn C and the loops A carried therein are illustrated in schematic perspective, and it will be observed that a space 14 is provided by a pair of filling yarns which are foreshortened permitting a pair of next adjacent filling yarns to form loops extending beyond the edge of webbing strips. While the loops may be arranged in any pattern with the spacing so as to permit intermeshing of the loops carried at opposite ends of the felts, the arrangement such as shown in FIG. 2A wherein a pair of next adjacent loops followed by a space afforded by foreshortening two filling yarns provides a desirable arrangement in that maximum utilization of space is provided with maximum loop area. It will be observed that a braided cover such as of Nomex, as manufactured by duPont is provided as a cover for the monofilament 16. The monofilament 16 provides the requisite stiffness and positioning ability to the loop, whereas the braided cover affords a desirable cushioning and covering effect for the seam area.

Figure 3A:
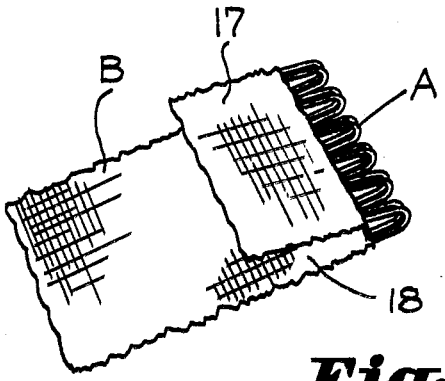
FIG. 3A is a perspective view further illustrating a seam webbing of FIG. 3.
Figure 3:
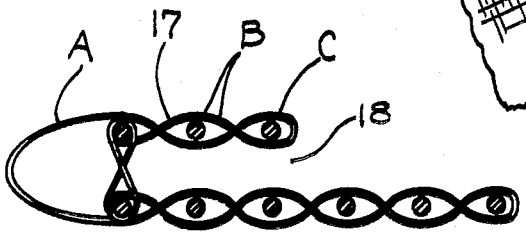
FIG. 3 is a sectional elevation similar to FIG. 2 but illustrating a modified form of the invention.

Referring more particularly to FIG. 3, a modified form of the invention illustrates the use of a pocket 18 which is provided by a weave wherein the upper portion 17 extends only partially across the webbing and wherein there has been an omission of binder yarns. FIG. 3A illustrates a variation in spacing and wherein Nomex braiding has not been employed but rather the monofilament alone forms the loops A.

A variety of weaves and loop spacings may be employed and if desired, the loops may take on a spiral type configuration. The versatility and variety of seam material is almost unlimited and provide important advantages adaptable to a variety of service conditions.

While a preferred embodiment of the invention has been described using specific terms, such description is for illustrative purposes only, and it is to be understood that changes and variations may be made without departing from the spirit or scope of the following claims.

What is claimed is:

1. A woven seam webbing formed from interwoven warp and filling yarns for use in receiving pintle means for joining dryer felts and the like comprising:

a series of spaced monofilament upright pintle receiving loops carried adjacent an edge of said webbing;

said monofilament loops being formed in spaced filling yarns; and said webbing adjacent said loops including an upper woven portion extending over only a partial portion of said webbing.

2. The structure set forth in claim 1 wherein the monofilament yarn forming said loops is covered with braided yarn.

3. The structure set forth in claim 1 wherein said monofilament loops are formed in a plurality of filling yarns next adjacent each other.

4. The structure set forth in claim 3 wherein said next adjacent yarns are in pairs.

5. The structure set forth in claim 1 wherein said webbing is an integral woven strip having a selvage at each edge.

* * * * *